US012747725B2

(12) United States Patent
Yamamoto et al.

(10) Patent No.: US 12,747,725 B2
(45) Date of Patent: Sep. 29, 2026

(54) PUMP DEVICE

(71) Applicant: IWAKI CO., LTD., Tokyo (JP)

(72) Inventors: Hironori Yamamoto, Iruma-gun (JP); Yoshio Ogawa, Iruma-gun (JP)

(73) Assignee: IWAKI CO., LTD., Tokyo (JP)

( * ) Notice: Subject to any disclaimer, the term of this patent is extended or adjusted under 35 U.S.C. 154(b) by 32 days.

(21) Appl. No.: 19/103,740

(22) PCT Filed: Aug. 17, 2022

(86) PCT No.: PCT/JP2022/031036

§ 371 (c)(1),
(2) Date: Feb. 13, 2025

(87) PCT Pub. No.: WO2024/038513

PCT Pub. Date: Feb. 22, 2024

(65) Prior Publication Data

US 2025/0270987 A1 Aug. 28, 2025

(51) Int. Cl.

| | |
|---|---|
| ***F04B 43/04*** | (2006.01) |
| ***F04B 35/04*** | (2006.01) |
| ***F04B 43/02*** | (2006.01) |
| ***F04B 53/16*** | (2006.01) |

(52) U.S. Cl.

CPC ..... *F04B 43/04* (2013.01); *F04B 35/045* (2013.01); *F04B 43/02* (2013.01); *F04B 53/16* (2013.01)

(58) Field of Classification Search

CPC ..... F04B 35/045; F04B 43/02; F04B 53/16; F04B 53/168; F04B 53/22; F04B 43/04

See application file for complete search history.

(56) References Cited

U.S. PATENT DOCUMENTS

| | | | | |
|---|---|---|---|---|
| 5,676,531 | A * | 10/1997 | Muscarella | F04B 53/147 417/413.1 |
| 11,215,154 | B2 * | 1/2022 | Saito | F04B 11/0016 |
| 2009/0110575 | A1 * | 4/2009 | Munakata | F04B 53/168 417/437 |
| 2012/0107155 | A1 * | 5/2012 | Fukano | F04B 43/04 417/413.1 |

FOREIGN PATENT DOCUMENTS

| | | | |
|---|---|---|---|
| JP | 2005220834 | A * | 8/2005 |
| JP | 2012-202274 | A | 10/2012 |

OTHER PUBLICATIONS

English translation and original of JP 2005220834 (Year: 2026).*

* cited by examiner

*Primary Examiner* — Dominick L Plakkoottam
(74) *Attorney, Agent, or Firm* — Oliff PLC

(57) ABSTRACT

A pump head, which has a different mounting pitch of mounting screws, and a bracket are enabled to be easily attached and detached to and from a pump body without disassembling a whole pump. A pump device includes: a drive source; a pump body that has a first wall and a housing space on one side of the first wall, the housing space housing the drive source inside; a pump head that has a pump chamber, a suction port, and a discharge port, and is attached to another side of the first wall, the suction port and the discharge port being for transfer fluid and communicating with the pump chamber; a bracket that is arranged between the pump head and the first wall; a drive member that is driven in the pump chamber by the drive source; and a nut plate that has an annular shape and is arranged adjacent to the first wall in the housing space of the pump body.

16 Claims, 8 Drawing Sheets

A-A CROSS SECTION

PUMP DEVICE

TECHNICAL FIELD

The present invention relates to a pump device.

BACKGROUND ART

Conventionally, a pump device has been known in which a pump head is attached to a pump body that houses a pump drive source. For example, taking a pump device of a type where a drive member such as a diaphragm reciprocates, the pump device of this type includes a drive source, such as a solenoid, housed inside a pump body. The drive source has, for example, a drive shaft, and the drive member is attached to the tip of the drive shaft. In the interior of the pump body, the drive source is fixed to the pump body by, for example, screwing from the mounting side of the pump head having a suction port and a discharge port that communicate with a pump chamber, for example (see Patent Literature 1, for example).

In this case, a bracket is provided on an end face of the pump body on the pump head mounting side. The bracket is provided with a plurality of nuts inserted at a pitch that corresponds to an arrangement interval (a mounting pitch) of mounting screws for the pump head. Thus, to attach the pump head to the pump body, the bracket is first integrated with the pump body, and then the pump head is attached to the bracket by screwing.

CITATION LIST

Patent Literature

Patent Literature 1: Japanese Patent Laid-Open No. 2012-202274

SUMMARY OF INVENTION

Technical Problem

However, the pump device disclosed in Patent Literature 1 described above has a problem that a pump head with a different mounting pitch of mounting screws according to the volume size of the pump chamber, for example, cannot be attached to the pump body in its original state.

To address this problem, the bracket needs to be replaced with a bracket to which, for example, nuts with a different pitch are inserted to enable the pump head with a different mounting pitch of mounting screws to be attached to the pump body. However, to replace the bracket, the whole pump must be disassembled by removing the pump body, the drive source, such as the solenoid, housed in the pump body, a back plate, and the like.

Moreover, it is impractical to insert a plurality of sets of nuts with different pitches into a bracket to allow the single bracket to accommodate a plurality of types of pump heads, due to, for example, interference between the nuts, reduced strength of the bracket, and reduced water resistance.

The present invention has been made in consideration of the above circumstances, and has an object to provide a pump device in which a pump head, which has a different mounting pitch of mounting screws, and the bracket can be easily attached and detached to and from the pump body without disassembling the whole pump.

Solution to Problem

A pump device according to one aspect of the present invention includes: a drive source; a pump body; a pump head; a bracket; a drive member; and a nut plate. The pump body has a first wall and a housing space housing the drive source inside on one side of the first wall. The pump head has a pump chamber, and a suction port and a discharge port for transfer fluid communicating with the pump chamber. The pump head is attached to another side of the first wall. The bracket is arranged between the pump head and the first wall. The drive member is driven in the pump chamber by the drive source. The nut plate is formed in an annular shape and is arranged adjacent to the first wall in the housing space of the pump body. The nut plate has a plurality of sets of nut holes at different distances from a center. The nut plate is arranged to be rotatable along the first wall around an axis which passes through the center and intersects with the first wall. The first wall has the plurality of hole sections which are arranged at positions corresponding to the plurality of sets of nut holes. Part of the plurality of hole sections are elongated hole sections which extend in a circumferential direction of the nut plate. The pump head and the bracket have a plurality of through holes that are arranged at a pitch which conforms to any one set of the plurality of sets of nut holes of the nut plate. The pump head and the bracket are fixed to the first wall of the pump body by fastening bolts, via the hole sections of the first wall, to the one set of the nut holes of the nut plate conforming to the pitch of the plurality of through holes.

In one embodiment of the present invention, the pump device further includes a waterproof plate that is arranged between the nut plate and the drive source in the housing space and liquid-tightly isolates the drive source from an outside of the pump body.

In another embodiment of the present invention, the pump device further includes a fixing plate that fixes the drive source from an opposite side to the first wall of the pump body and is attached to the pump body to block the housing space.

In still another embodiment of the present invention, the drive source has a drive shaft to a tip of which the drive member is attached. Further, in the nut plate, at least one set of the nut holes of the plurality of sets of nut holes is arranged in different positions in a circumferential direction of the nut plate with respect to other sets of the nut holes.

In still another embodiment of the present invention, the first wall has a central opening, a plurality of first elongated hole sections, a plurality of second elongated hole sections, and a plurality of round hole sections. Through the central opening, the drive shaft of the drive source is inserted. The plurality of first elongated hole sections are formed around the central opening to radially open. In the plurality of first elongated hole sections, part of the nut holes of the plurality of sets of nut holes appear at a position of the nut plate in a rotation direction. The plurality of second elongated hole sections are formed around the central opening to open along a circumferential direction of the central opening while being spaced apart from the plurality of first elongated hole sections. In the plurality of second elongated hole sections, other part of the nut holes of the plurality of sets of nut holes appear at a position of the nut plate in the rotation direction. The plurality of round hole sections are arranged around the central opening to be spaced apart from the plurality of first elongated hole sections and the plurality of second elongated hole sections. In the plurality of round hole sections, other remaining nut holes of the plurality of sets of nut holes appear at a position of the nut plate in the rotation direction.

In still another embodiment of the present invention, the first wall further has a third elongated hole section. The third elongated hole section is formed around the central opening to radially open while being spaced apart from the plurality of first elongated hole sections, the plurality of second elongated hole sections and the plurality of round hole sections. In the third elongated hole section, one nut hole of a set of the plurality of sets of nut holes appears at a position of the nut plate in the rotation direction.

In still another embodiment of the present invention, the plurality of sets of nut holes, which are provided in the nut plate, have first nut holes, second nut holes, and third nut holes. Each of the second nut holes is provided at a position at a longer distance from the center than the first nut holes. Each of the third nut holes is provided at a position at a longer distance from the center than the second nut holes. Further, the first nut holes and the third nut holes are arranged at the same positions in a circumferential direction and are respectively and evenly arranged at four positions in the circumferential direction. The second nut holes are evenly arranged at four positions in the circumferential direction and are arranged at positions which are deviated by 45° in the circumferential direction with respect to the first nut hole and the third nut hole.

In still another embodiment of the present invention, the waterproof plate is formed of a resin member that has a disk portion, a first fitting portion, a second fitting portion, and a third fitting portion. The disk portion is opposed to the nut plate. The first fitting portion protrudes along the drive shaft from an inner peripheral edge portion of the disk portion and is fitted in an inner peripheral portion of the nut plate. The second fitting portion protrudes from the first fitting portion along the drive shaft and is fitted in the central opening of the first wall. The third fitting portion is fitted in an inner peripheral wall of the housing space.

In still another embodiment of the present invention, the waterproof plate has a first sealing portion and a second sealing portion. The first sealing portion is arranged in an outer peripheral portion of the second fitting portion. The first sealing portion seals a portion between the waterproof plate and an inner peripheral portion of the central opening of the first wall. The second sealing portion is arranged in an outer peripheral portion of the disk portion. The second sealing portion seals a portion between the waterproof plate and the inner peripheral wall of the housing space.

In still another embodiment of the present invention, the drive source and the waterproof plate are fixed to an inside of the housing space of the pump body by fastening bolts to mounting nuts, which are provided on an outside of the housing space of the pump body, via a plurality of through holes provided in the fixing plate.

In still another embodiment of the present invention, the pump body is formed of a resin member. Further, the mounting nuts are integrally embedded in the pump body.

In still another embodiment of the present invention, in a state where the housing space of the pump body is tightly closed, the bracket is attached to the first wall of the pump body to be exchangeable for each pitch of the plurality of through holes which corresponds to any one set of the nut holes among the first nut holes, the second nut holes and the third nut holes of the nut plate.

In still another embodiment of the present invention, the nut plate tightly contacts with the one side of the first wall of the pump body to be unrotatable when the pump head and the bracket are fixed to the other side of the first wall of the pump body.

Advantageous Effect of Invention

According to the present invention, it becomes possible to easily attach and detach a pump head, which has a different mounting pitch of mounting screws, and a bracket to and from a pump body without disassembling a whole pump.

DESCRIPTION OF EMBODIMENT

Figure 1:
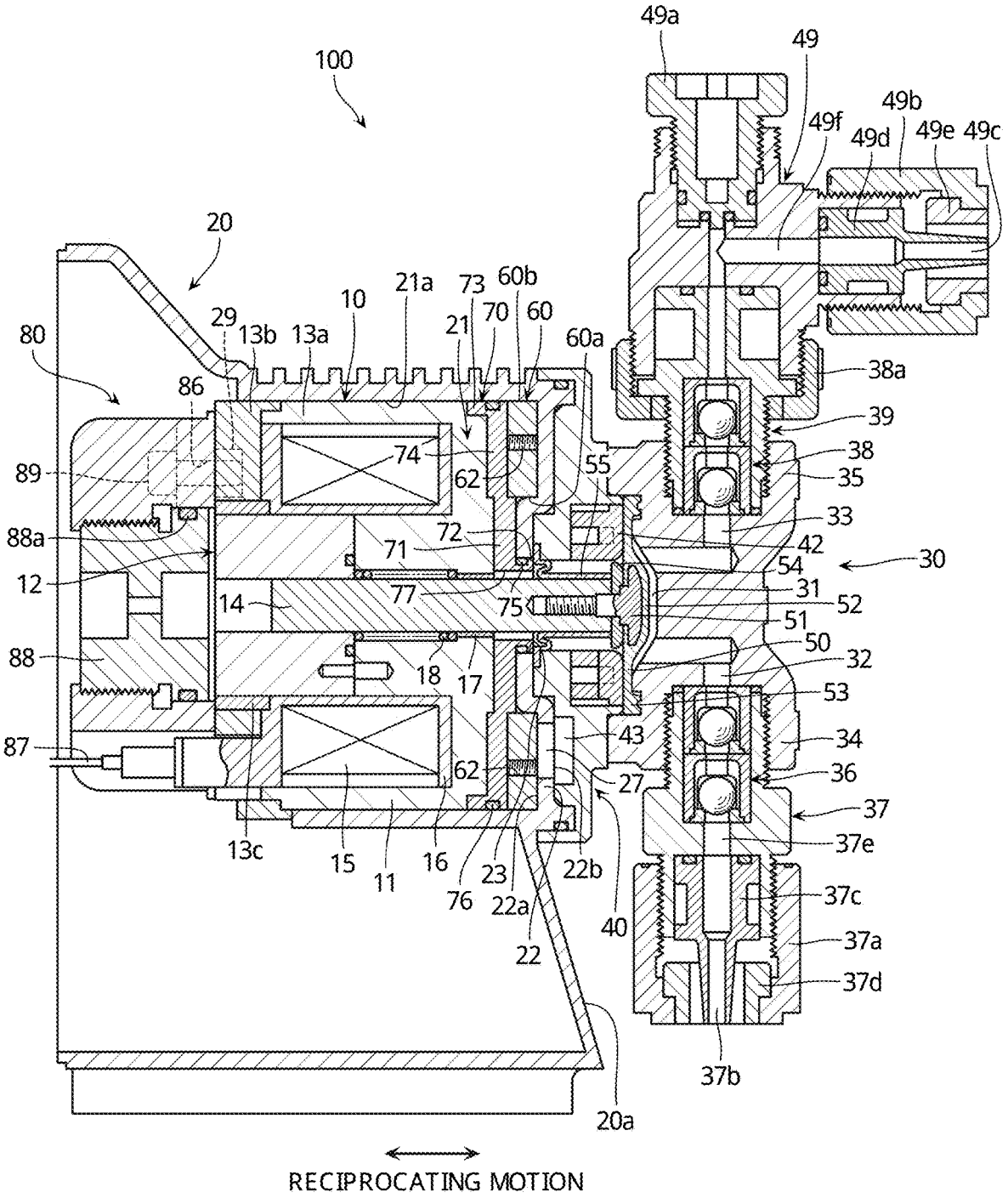
FIG. 1 is a cross-sectional view illustrating a whole configuration of a pump device according to one embodiment of the present invention.

The following will describe a pump device according to an embodiment of the present invention in detail, with reference to the accompanying drawings. However, the following embodiment does not limit the invention according to each of the claims, and all of combinations of features described in the embodiment are not necessarily required for solutions in the invention.

Further, in the following embodiment, the same or corresponding components are denoted by the same reference characters, and descriptions thereof will not be repeated. Further, in the embodiment, there are cases where arrangement, scales, dimensions, and the like of the configuration elements are exaggerated or minimized and are illustrated in a state where those do not agree with actual configuration elements and where illustrations are provided while part of the configuration elements are not indicated.

Figure 2:
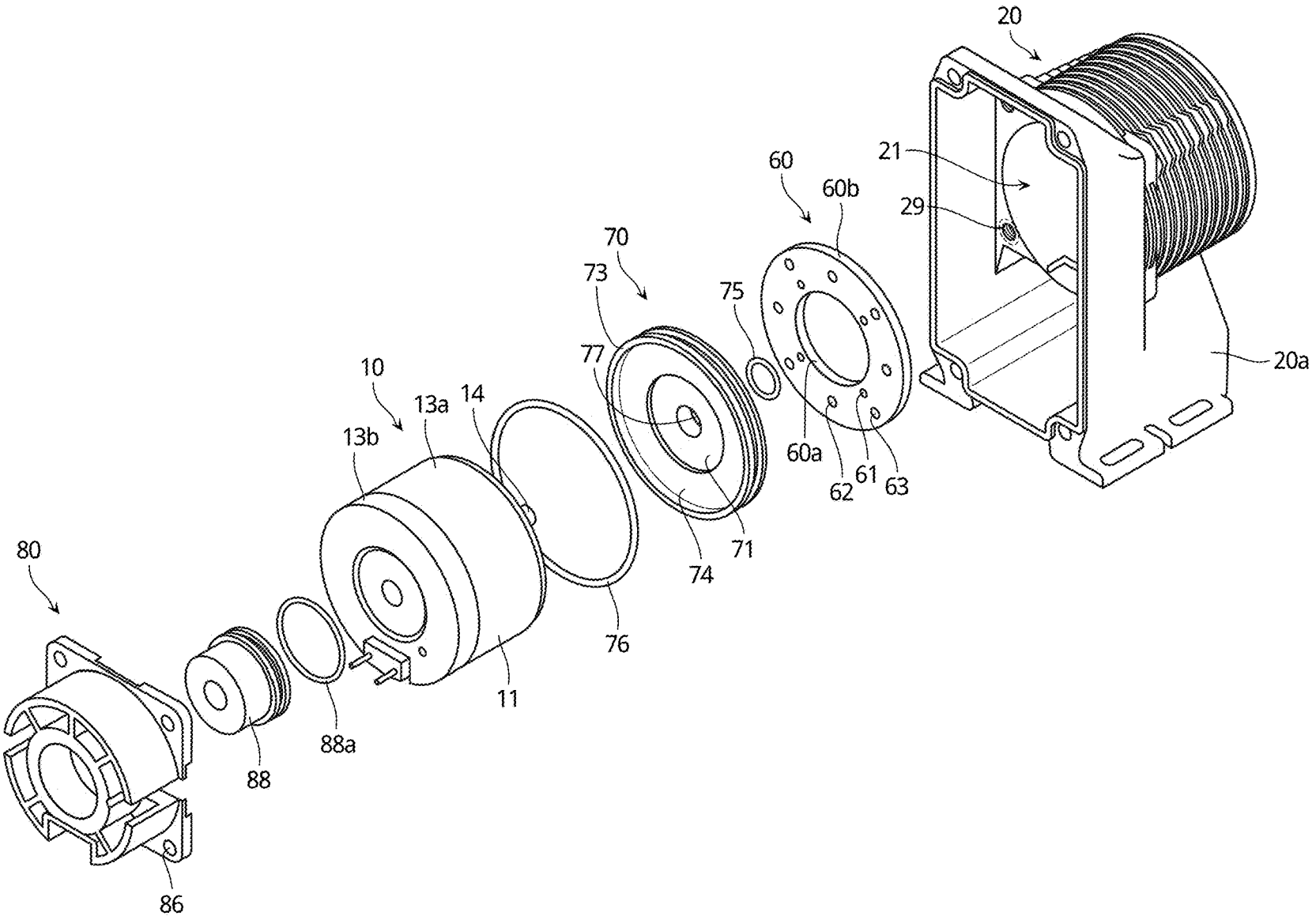
FIG. 2 is an exploded perspective view illustrating each portion housed in a pump body of the pump device.

FIG. 1 is a cross-sectional view illustrating a whole configuration of a pump device according to one embodiment of the present invention. FIG. 2 is an exploded perspective view illustrating each portion housed in a pump body of the pump device.

As illustrated in FIG. 1 and FIG. 2, a pump device 100 according to the present embodiment includes a solenoid 10 as a drive source, a pump body 20 which houses the solenoid 10 in its interior, and a pump head 30 which is attached to the pump body 20. Further, the pump device 100 includes a bracket 40 for attaching the pump head 30 to the pump body 20, a reciprocating member as a drive member, for example, a flexible diaphragm 50. In the following, a direction towards a pump head 30 mounting side of the pump body 20 is set as front, and a direction towards an opposite side to that is set as rear.

The solenoid 10 includes a stator 11 and a movable element 12. The stator 11 includes a first yoke 13*a* formed in a bottomed cylindrical shape with an inner peripheral portion protruding rearward, a cylindrical coil 15 housed in the first yoke 13*a*, a bobbin 16 around which the coil 15 is wound, and a second yoke 13*b* which blocks an opening of the first yoke 13*a* in its rear area and fixes the bobbin 16 around which the coil 15 is wound. The first yoke 13*a*, the second yoke 13*b*, and the movable element 12 are formed of a magnetic material.

The movable element 12 is formed in a ring shape and is housed in a cylindrical space from a protrusion portion of the inner peripheral portion of the first yoke 13*a* to a rear end position of the second yoke 13*b*. A drive shaft 14 is fixed in a center hole of the movable element 12 by using a method such as press fitting. The drive shaft 14 is inserted into a central position of the stator 11, specifically, an inside of the inner peripheral portion of the first yoke 13*a* and is supported by a bearing 17 to be capable of reciprocating motion in an axis direction. The movable element 12 is supported to be capable of reciprocating motion in the axis direction by a bearing 13*c* which is installed on an inner periphery of the second yoke 13*b*. In the inner peripheral portion of the first yoke 13*a*, a ring-shaped spring housing space which is open on a rear side is formed, and a return spring 18 which exerts spring force for moving the movable element 12 rearward is installed between the spring housing space and the movable element 12. The solenoid 10 drives the drive shaft 14 in a reciprocating direction indicated by arrows in FIG. 1 due to electromagnetic force of the coil 15 and the spring force of the return spring 18. When the drive shaft 14 is positioned in a front area as illustrated in FIG. 1, this indicates a state where the coil 15 is energized. At a tip of the drive shaft 14, the diaphragm 50 is installed via an insert bolt 51.

The pump body 20 is formed of a resin member. The pump body 20 has a front wall 22 as a first wall which is provided on a front side and a pump base 20*a*. Further, the pump body 20 has a housing space 21 which is provided above the pump base 20*a* and on a back surface 22*a* side (one side) of the front wall 22. The housing space 21 of the pump body 20 is formed in a cylindrical shape. The housing space 21 houses the solenoid 10 inside. Note that in the housing space 21 of the pump body 20, together with the solenoid 10, a nut plate 60, which will be described later, and a waterproof plate 70 are housed. Further, the front wall 22 of the pump body 20 has a plurality of hole sections which are arranged in positions corresponding to a plurality of sets of nut holes of the nut plate 60, which will be described later.

The pump head 30 is formed of a resin member or a metal component such as stainless steel. The pump head 30 has a pump chamber 31 which is formed in a central position. The pump head 30 has a plurality of mounting holes (through holes) 19 (see FIG. 6) which are arranged at a predetermined pitch. The pump head 30 is attached to a front surface 22*b* side (another side) of the front wall 22 of the pump body 20, for example, via the bracket 40. The pump head 30 and the bracket 40 configure a minimum unit of a pump unit which is attached to the pump body 20.

The pump head 30 has a suction port 32 and a discharge port 33 for transfer fluid, which communicate with the pump chamber 31. The suction port 32 of the pump head 30 communicates with a lower area of the pump chamber 31. The discharge port 33 of the pump head 30 communicates with an upper area of the pump chamber 31.

In the pump head 30, a first connection port 34 on a suction side of the transfer fluid, which is arranged below the suction port 32, is formed. Further, in the pump head 30, a second connection port 35 on a discharge side of the transfer fluid, which is arranged above the discharge port 33, is formed. The first and second connection ports 34 and 35 communicate with the pump chamber 31 respectively via the suction port 32 and the discharge port 33.

A cylindrical first connection adapter 37 which incorporates a suction valve 36 is connected to the first connection port 34. A cylindrical second connection adapter 39 which incorporates a discharge valve 38 is connected to the second connection port 35. A hose adapter 37*c* is inserted and installed in a lower side of the first connection adapter 37. A cylindrical hose stopper 37*d* is installed in a tip side of the hose adapter 37*c*. An outer peripheral portion on the lower side of the first connection adapter 37 is connected to a cylindrical first joint 37*a* which houses the hose stopper 37*d* such that the hose stopper 37*d* is capable of moving close to or away from the hose adapter 37*c*. The first joint 37*a* connects a suction side flow path 37*b* of the transfer fluid, which passes through a central portion of the hose adapter 37*c* and extends to a lower side of the pump head 30, to a flow path 37*e* of the first connection adapter 37.

The second connection adapter 39 is connected to a third connection adapter 49 via a connection nut 38*a*. The third connection adapter 49 is formed in a three-way branching cylindrical shape which has a T-shaped cross section. A gas venting adjustment screw 49*a* is connected to an upper side of the third connection adapter 49. A gas venting joint and a gas venting flow path, which are not illustrated, are connected to a lateral side of the third connection adapter 49. A hose adapter 49*d* is inserted and installed in a front side of the third connection adapter 49. A cylindrical hose stopper 49*e* is installed in a tip side of the hose adapter 49*d*. An outer peripheral portion on the front side of the third connection adapter 49 is connected to a cylindrical second joint 49*b* which houses the hose stopper 49*e* such that the hose stopper 49*e* is capable of moving close to or away from the hose adapter 49*d*.

The second joint 49*b* connects a discharge side flow path 49*c* of the transfer fluid, which passes through a central portion of the hose adapter 49*d* and extends to a front side of the pump head 30, to the second connection adapter 39 via a flow path 49*f* of the third connection adapter 49. Note that each of the suction valve 36 and the discharge valve 38 is configured with a common valve cartridge of a two-stage ball valve, in which ball valves are arranged in two stages in an up-down direction, for example.

The bracket 40 is formed of a resin member. The bracket 40 is arranged between the pump head 30 and the front wall 22 of the pump body 20. The bracket 40 has a plurality of through holes 41 (see FIG. 6 and FIG. 7) which are arranged at a predetermined pitch. The predetermined pitch is a pitch which conforms to any one set of nut holes among the plurality of sets of nut holes of the nut plate 60 which will be described later, for example. The diaphragm 50 is a member in which the insert bolt 51 is integrally molded in an interior of a resin such as a polytetrafluoroethylene resin (PTFE) or ethylene propylene rubber (EPDM). The diaphragm 50 is driven by the solenoid 10, which is housed in the pump body 20, in the pump chamber 31 of the pump head 30. The diaphragm 50 is attached liquid-tightly in a state where a peripheral edge portion 53 is interposed between the bracket 40 and a support member 42 and the pump head 30, and a front side of a central portion 52 faces the pump chamber 31.

Note that a diaphragm seal 55 is attached to a rear side of a retainer 54 which is arranged between the diaphragm 50 and the tip of the drive shaft 14, the diaphragm seal 55 sealing a portion between an outer peripheral surface of the drive shaft 14 and a rear end surface of the bracket 40, the diaphragm seal 55 being formed of an elastic body which is partially formed in a bellows shape. Because a portion formed in the bellows shape serves as a buffer member, the diaphragm seal 55 is configured to be capable of sustaining sealability during reciprocating motion of the drive shaft 14.

Figure 3:
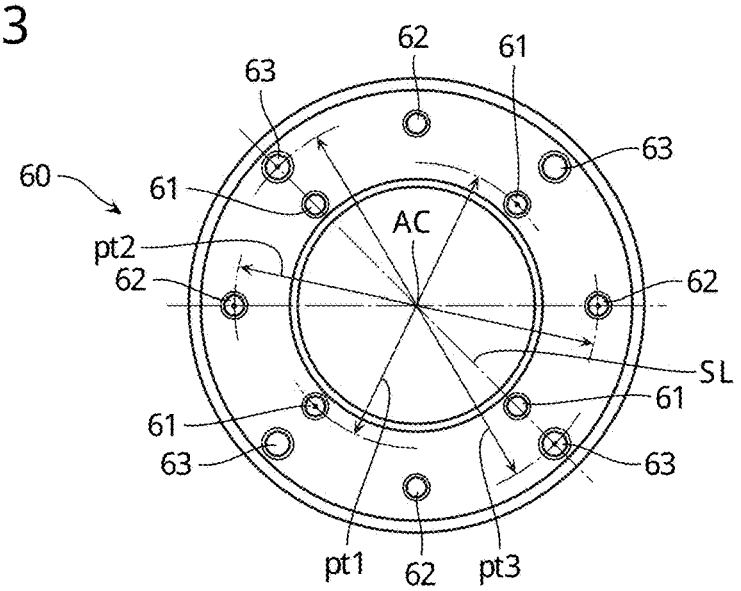
FIG. 3 is a front view illustrating a nut plate to be housed in a housing space of the pump body.

FIG. 3 is a front view illustrating the nut plate 60 to be housed in the housing space 21 of the pump body 20.

As illustrated in FIG. 2 and FIG. 3, the nut plate 60 is formed of a metal plate formed in an annular shape. The nut plate 60 is arranged adjacent to the front wall 22 in the housing space 21 of the pump body 20 (see FIG. 1).

The nut plate 60 has a plurality of sets of first nut holes 61, second nut holes 62, and third nut holes 63, which are at different distances from a center AC. Note that the second nut hole 62 is provided at a position at a longer distance from the center AC than the first nut holes 61. Further, the third nut hole 63 is provided at a position at a longer distance from the center AC than the second nut holes 62. The nut plate 60 is arranged to be rotatable, in the housing space 21, along the front wall 22 around an axis which passes through the center AC and intersects with the front wall 22. The nut plate 60 is formed such that radial intervals (pitches), which pass through the center AC, of the plurality of sets of the first nut holes 61, the second nut holes 62, and the third nut holes 63 are different.

Further, in the nut plate 60, at least one set of the nut holes among the plurality of sets of the first nut holes 61, the second nut holes 62, and the third nut holes 63 is arranged at different positions in a circumferential direction of the nut plate 60 with respect to the other sets of the nut holes. For example, a plurality of first nut holes 61 are formed in positions close to an inner peripheral portion 60*a* of the nut plate 60. The first nut holes 61 are evenly arranged in four positions in the circumferential direction at 90° intervals in the circumferential direction of the nut plate 60, for example. A plurality of second nut holes 62 are formed in positions between the inner peripheral portion 60*a* and an outer peripheral portion 60*b* of the nut plate 60, the positions being at longer distances from the center AC than the first nut holes 61. The second nut holes 62 are evenly arranged in four positions in the circumferential direction at 90° intervals in the circumferential direction, each of the four positions being deviated by 45° in the circumferential direction with respect to the first nut hole 61, for example. A plurality of third nut holes 63 are formed in positions close to the outer peripheral portion 60*b* of the nut plate 60, the positions being at longer distances from the center AC than the second nut holes 62. The third nut holes 63 are evenly arranged in four positions in the circumferential direction at 90° intervals in the circumferential direction, each of the four positions being the same position in the circumferential direction as that of the first nut hole 61 and being deviated by 45° in the circumferential direction with respect to the second nut hole 62.

Consequently, the first nut holes 61 and the third nut holes 63 are each formed to be aligned on a straight line SL in the radial direction, but the second nut holes 62 are formed at positions deviated in the circumferential direction, and this thus results in the following advantages. That is, when an attempt is made to form nut holes at a short pitch on the straight line SL in the radial direction, there might be cases where the nut holes interfere or overlap with each other at a design phase and thereby cannot be formed physically. The nut plate 60 of the present embodiment can handle even such a case where it is necessary to form the nut holes at short pitches which are slightly different. In other words, the nut plate 60 makes it possible to effectively provide, in one plate, nut holes at a plurality of kinds of short pitches.

Specifically, an arrangement pitch of one set of the first nut holes 61 forms a smallest mounting pitch (first pitch pt1) of the pump head 30 and the bracket 40. Further, an arrangement pitch of one set of the third nut holes 63 forms a largest mounting pitch (third pitch pt3) of the pump head 30 and the bracket 40. Furthermore, an arrangement pitch of one set of the second nut holes 62 forms a mounting pitch (second pitch pt2) which is larger than the mounting pitch of the first nut holes 61 and is smaller than the mounting pitch of the third nut holes 63 (pt1<pt2<pt3).

A waterproof plate 70 is arranged between the nut plate 60 and the solenoid 10 in the housing space 21. The waterproof plate 70 is formed of a resin member which is formed in a disk shape. The waterproof plate 70 liquid-tightly isolates the solenoid 10 in the housing space 21 from an outside of the pump body 20.

The waterproof plate 70 has a disk portion 74, a first fitting portion 71, a second fitting portion 72, and a third fitting portion 73. The disk portion 74 forms an annular main portion of the waterproof plate 70. The disk portion 74 is opposed to a back surface of the nut plate 60. The first fitting portion 71 protrudes from an inner peripheral edge portion of the disk portion 74 to the front wall 22 side of the pump body 20. The first fitting portion 71 is fitted in the inner peripheral portion 60*a* of the nut plate 60. The second fitting portion 72 protrudes from the first fitting portion 71 to the front wall 22 side of the pump body 20. The second fitting portion 72 is fitted in a central opening 23, which will be described later, of the front wall 22 of the pump body 20.

At a center of the first and second fitting portions 71 and 72, a central through hole 77 is formed through which the drive shaft 14 of the solenoid 10 passes. The first and second fitting portions 71 and 72 are formed to protrude along the drive shaft 14 of the solenoid 10. The third fitting portion 73 is positioned in an outer peripheral edge portion of the disk portion 74 and is fitted in an inner peripheral wall 21*a* of the housing space 21 of the pump body 20. The third fitting portion 73 protrudes to an opposite side to the first fitting portion 71 and the second fitting portion 72, for example.

Note that the waterproof plate 70 has an O-ring 75 as a first sealing portion and an O-ring 76 as a second sealing portion. The O-rings 75 and 76 are formed of a resin such as fluororubber (FKM) or ethylene propylene rubber (EPDM). The O-ring 75 is arranged on an outer peripheral portion of the second fitting portion 72. Accordingly, the O-ring 75 seals a portion between the outer peripheral portion of the second fitting portion 72 and an inner peripheral portion of the central opening 23 of the front wall 22. The O-ring 76 is arranged in an outer peripheral portion of the disk portion 74. Accordingly, the O-ring 76 seals a portion between the outer peripheral portion of the disk portion 74 and the inner peripheral wall 21*a* of the housing space 21 of the pump body 20.

During assembly of the pump device 100, the nut plate 60, the waterproof plate 70, and the solenoid 10 are inserted, in order from the back surface 22*a* of the front wall 22, into the housing space 21 of the pump body 20. Then, a fixing plate 80 is attached to a back surface side of the solenoid 10 in the rear of the pump body 20. The fixing plate 80 fixes the solenoid 10 from an opposite side to the front wall 22 of the pump body 20. The fixing plate 80 is attached to the pump body 20 to block the housing space 21. Consequently, the solenoid 10 and the waterproof plate 70 are fixed to the pump body 20 from the rear of the pump body 20 by the fixing plate 80.

That is, fixing bolts 89 are fastened to mounting nuts 29, which are provided on an outside of the housing space 21 of the pump body 20, via a plurality of through holes 86 which are provided in the fixing plate 80, and the solenoid 10 and the waterproof plate 70 are thereby fixed to the housing space 21 of the pump body 20. Note that the mounting nuts 29 are integrally embedded in the pump body 20 by insert molding or the like, for example.

To a back surface side of the fixing plate 80, for example, control wiring 87 which is connected to a control board is drawn out. Further, into a central position of the fixing plate 80, a stopper 88 for adjusting strokes of the movable element 12 of the solenoid 10 is screwed. An O-ring 88*a* is attached between the fixing plate 80 and the stopper 88 and is fixed such that the stopper 88 does not rotate due to vibration or the like during operation of the pump device 100.

Meanwhile, after the pump body 20 is assembled, a predetermined bracket 40 is installed on the front wall 22 of the pump body 20, and further a predetermined pump head 30 is installed thereon. In other words, the pump head 30 and the bracket 40 are fixed to the front wall 22 of the pump body 20 by fastening the mounting bolts 68 (see FIG. 6) via the plurality of hole sections of the front wall 22 to one set of the nut holes of the nut plate 60 which is arranged in the housing space 21 of the pump body 20, which conforms to the pitches of the pluralities of mounting holes 19 and through holes 41.

Figure 4:
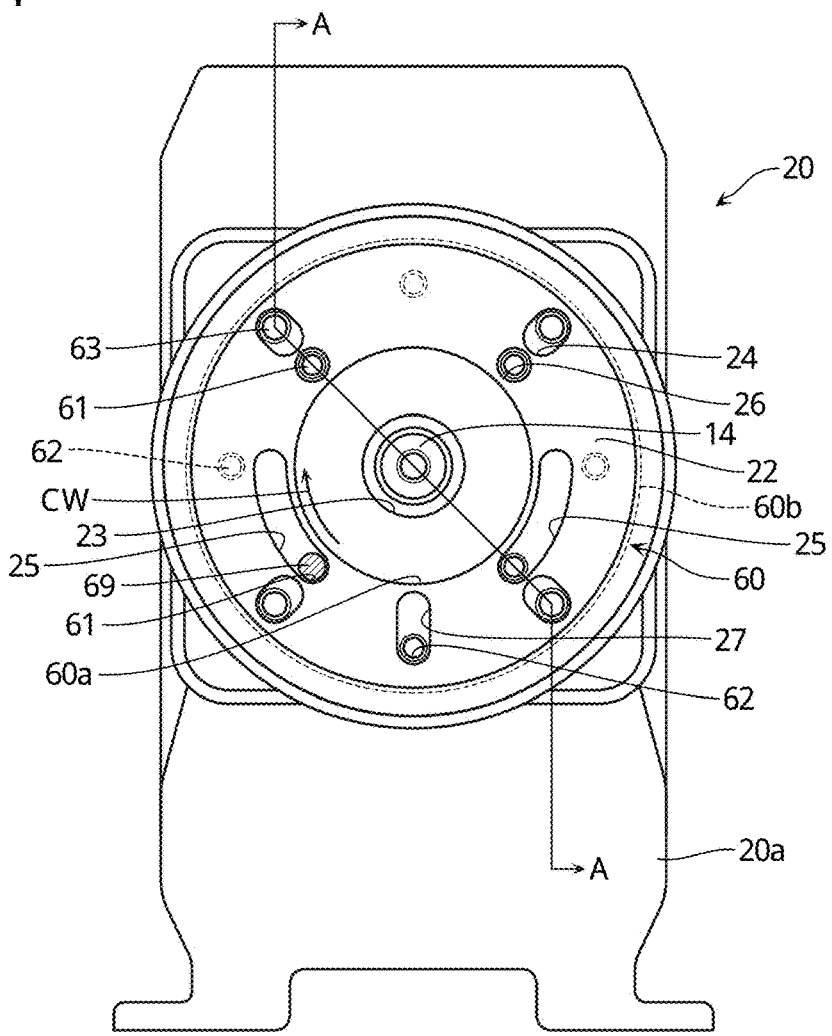
FIG. 4 is a diagram illustrating a front side of the pump body.
Figure 5:
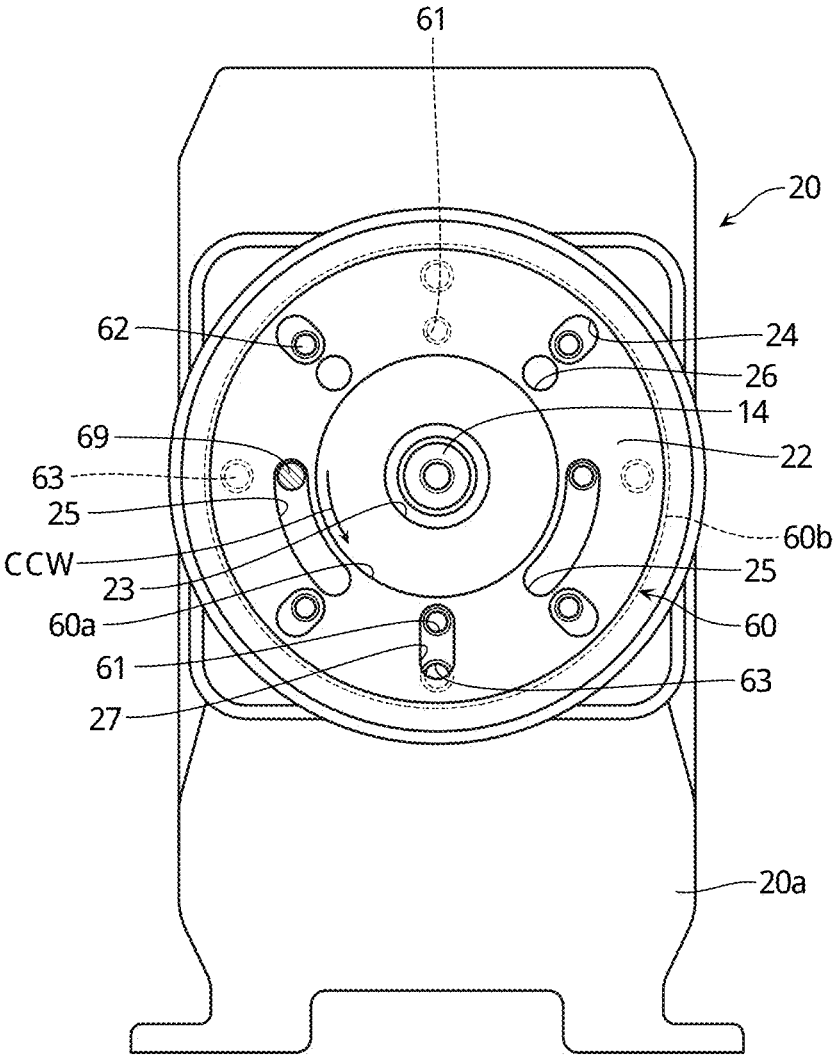
FIG. 5 is a diagram illustrating the front side of the pump body.
Figure 6:
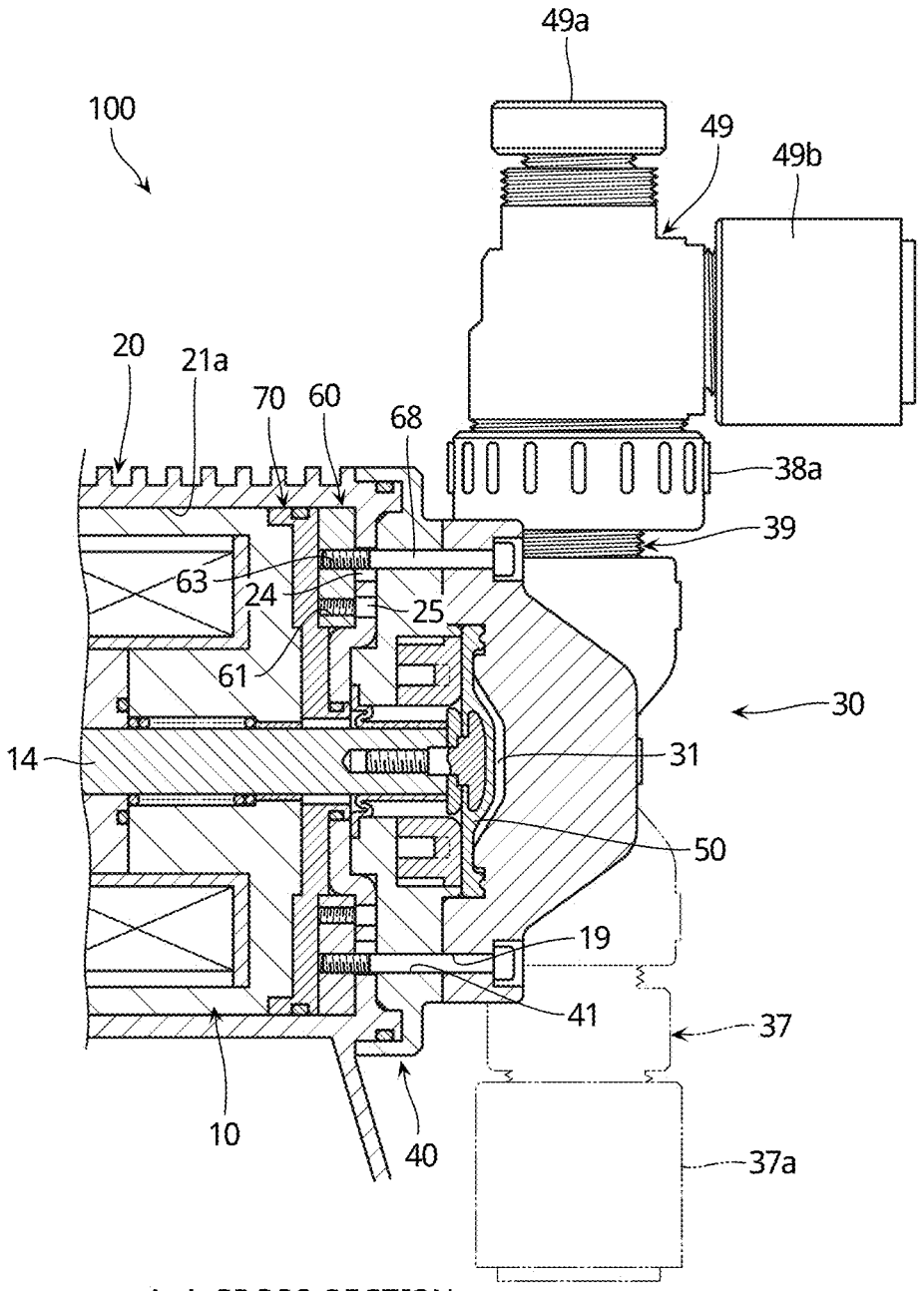
FIG. 6 is a diagram illustrating a cross section taken along line A-A in FIG. 4.
Figure 7:
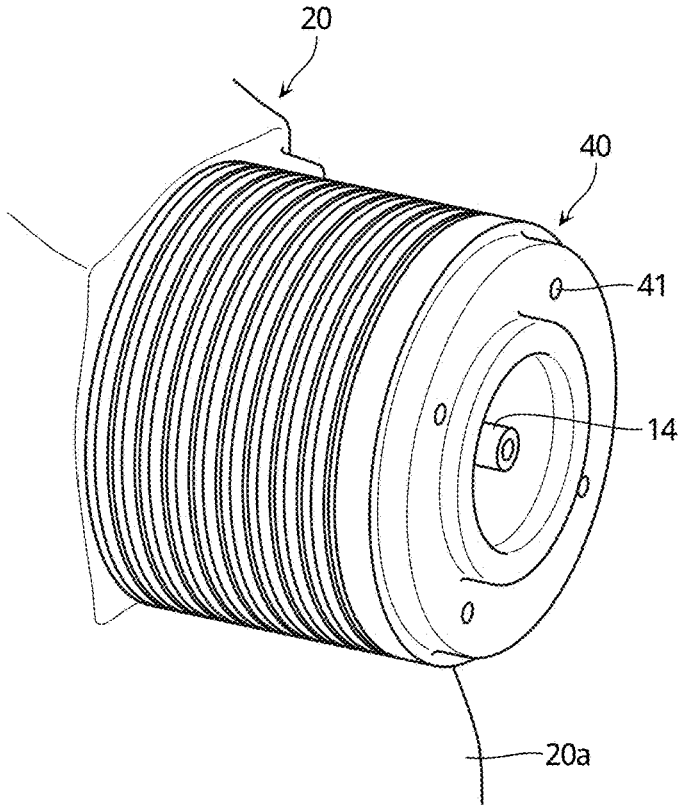
FIG. 7 is a perspective view illustrating a state where a bracket having through holes at a predetermined pitch is installed on the pump body.
Figure 8:
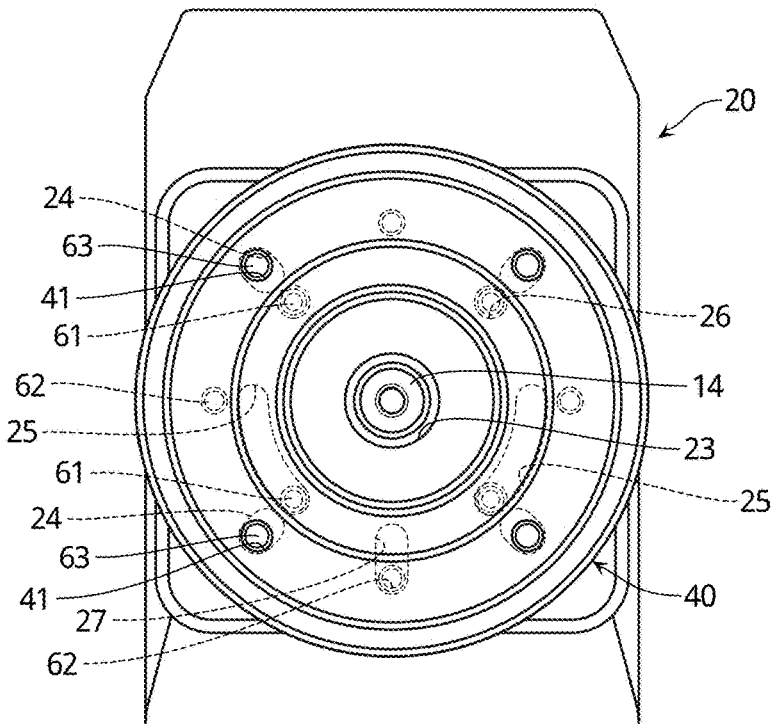
FIG. 8 is a front view illustrating the state where the bracket having through holes at the predetermined pitch is installed on the pump body.
Figure 9:
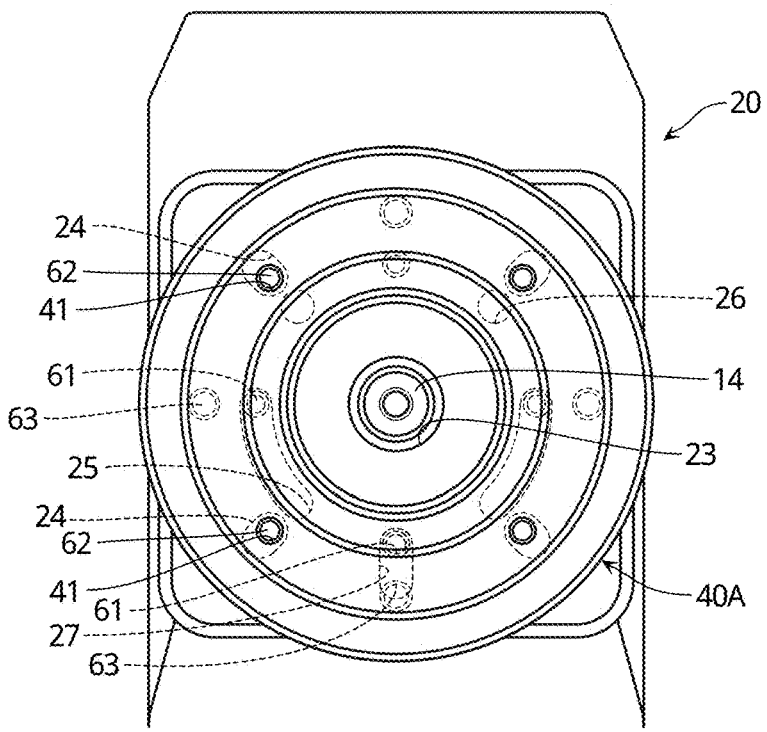
FIG. 9 is a front view illustrating the state where the bracket having through holes at the predetermined pitch is installed on the pump body.
Figure 10:
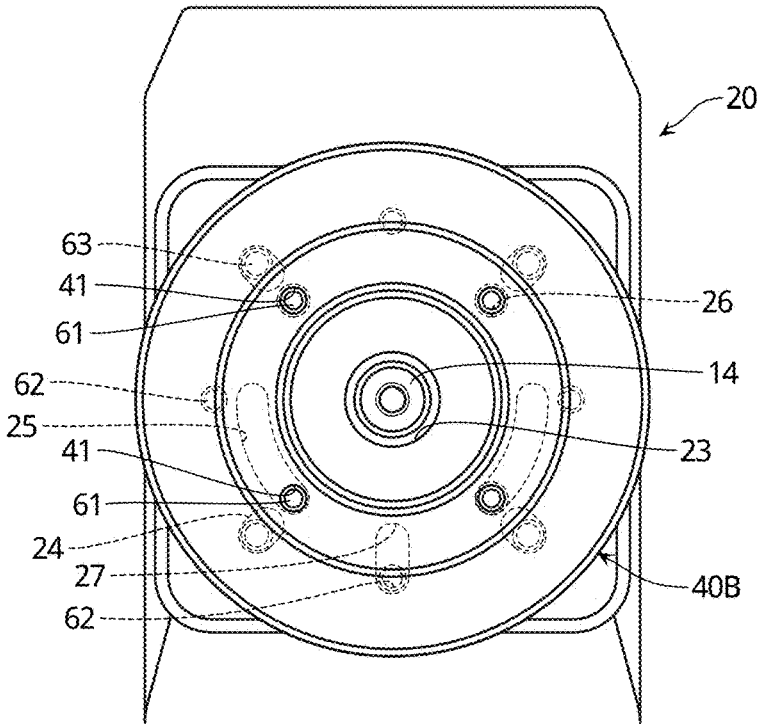
FIG. 10 is a front view illustrating the state where the bracket having through holes at the predetermined pitch is installed on the pump body.
Figure 11:
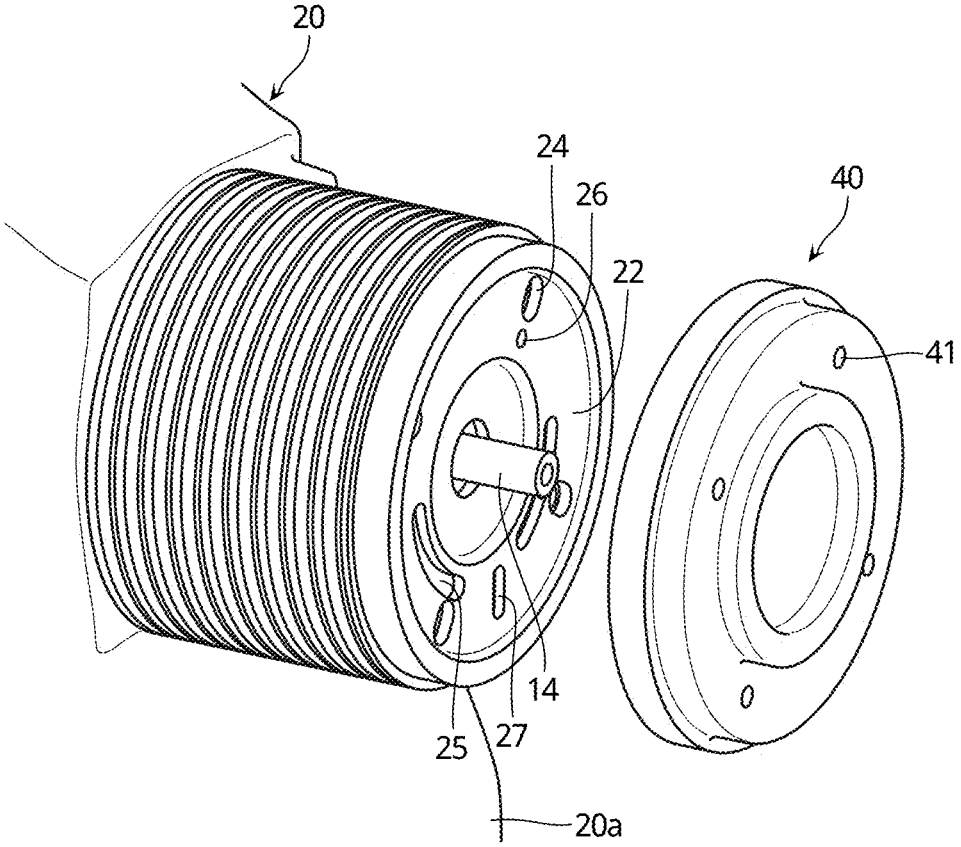
FIG. 11 is a perspective view illustrating a state where the bracket is detached from the pump body.

FIGS. 4 and FIG. 5 are diagrams illustrating the front side of the pump body 20. FIG. 6 is a diagram illustrating a cross section taken along line A-A in FIG. 4. However, FIG. 6 illustrates a configuration in FIG. 4 to which the pump head 30, the bracket 40, and the diaphragm 50 are added. FIG. 7 is a perspective view illustrating a state where the bracket 40 having the through holes 41 at the predetermined pitch are installed on the pump body 20. FIG. 8 to FIG. 10 are front views illustrating the state where the bracket 40 having the through holes 41 at the predetermined pitch are installed on the pump body 20. FIG. 11 is a perspective view illustrating a state where the bracket 40 is detached from the pump body 20.

As illustrated in FIGS. 4 and FIG. 5, the front wall 22 of the pump body 20 has the central opening 23 and, as a plurality of hole sections, a plurality of first elongated hole sections 24, a plurality of second elongated hole sections 25, a plurality of round hole sections 26, and a third elongated hole section 27. The central opening 23 opens from the housing space 21 to the front side of the front wall 22, coaxially with the drive shaft 14 of the solenoid 10. The second fitting portion 72 of the waterproof plate 70 is fitted in the central opening 23 via the O-ring 75, and the drive shaft 14 of the solenoid 10 is inserted into the central through hole 77.

As for the plurality of first elongated hole sections 24, for example, four elongated hole sections 24 are formed around the central opening 23 such that the first elongated hole sections 24 radially open at 90° intervals at equal distance positions from the center of two lines, which pass through the center and obliquely extend at angles of 45° when viewed from the front. As for the second elongated hole sections 25, for example, two second elongated hole sections 25 are formed around the central opening 23 such that the second elongated hole sections 25 are spaced apart from the plurality of first elongated hole sections 24 and open, along a circumferential direction of the central opening 23, to oblique 45° positions at which the second elongated hole sections 25 approach each other downward from left and right equal distance positions across the center when viewed from the front. As for the plurality of round hole sections 26, for example, two round hole sections 26 are formed around the central opening 23 such that the round hole sections 26 are spaced apart from the plurality of the first elongated hole sections 24 and the plurality of second elongated hole sections 25 and are arranged at 90° intervals on a side, on which the second elongated hole sections 25 are not formed, at the same distances as those of the second elongated hole sections 25 from the center of two lines which pass through the center and obliquely extend at angles of 45° when viewed from the front. In addition, the front wall 22 is provided with the third elongated hole section 27 for temporarily fixing the nut plate 60.

As for the third elongated hole section 27, for example, one third elongated hole section 27 is formed around the central opening 23 such that the third elongated hole section 27 is spaced apart from the plurality of first elongated hole sections 24, the plurality of second elongated hole sections 25, and the plurality of round hole sections 26 and radially opens downward from a position at which a distance from the center is equal to the distances of the plurality of second elongated hole sections 25 from the center on a vertical line which passes through the center when viewed from the front. In a state where the nut holes of the nut plate 60 appear through all of the plurality of first elongated hole sections 24, the plurality of second elongated hole sections 25, and the plurality of round hole sections 26 or in a state where the nut holes of the nut plate 60 appear through all of the plurality of first elongated hole sections 24 and the plurality of second elongated hole sections 25, one nut hole of a set of the plurality of sets of the nut holes appears through the third elongated hole section 27.

Consequently, formation is made such that in a position of the nut plate 60 in a rotation direction, part of the nut holes among the plurality of sets of nut holes 61 to 63, other part of nut holes, the remaining other nut holes, and one nut hole of a set respectively appear (are exposed) through the plurality of first elongated hole sections 24, the plurality of second elongated hole sections 25, the plurality of round hole sections 26, and the third elongated hole section 27 of the front wall 22. Furthermore, in the present embodiment, the hole sections 24 to 26 of the front wall 22, the first to third nut holes 61 to 63 of the nut plate 60 are formed such that their mounting pitches are changed among at least three kinds in accordance with a rotation position of the nut plate 60.

Here, in order to rotate and operate the nut plate 60 which is arranged adjacent to the front wall 22 in the housing space 21 of the pump body 20, for example, as illustrated in FIG. 4, in a state where the pump head 30, the bracket 40, and the diaphragm 50 are detached from the front wall 22, an operation jig (such as a bolt or a screwdriver) 69 is attached to the first nut hole 61 which appears in an opening end portion in a lower area of the second elongated hole section 25 on a left side as viewed from the front, for example.

Then, by appropriately operating the operation jig 69, the nut plate 60 on the back surface 22*a* side of the front wall 22 is rotated by 45°, for example, in a direction indicated by an arrow CW in FIG. 4. In a state, which is illustrated in FIG. 4, before rotation and where the operation jig 69 is not attached, the plurality of nut holes 61 are respectively exposed through the opening end portions (oblique 45° positions) in the lower areas of the plurality of second elongated hole sections 25 and are respectively exposed through the plurality of round hole sections 26, for example. Further, at the same time, the plurality of third nut holes 63 are respectively exposed through opening end portions of the plurality of first elongated hole sections 24, which are more distant from the central openings 23, for example.

In this state, the plurality of first nut holes 61 of the nut plate 60 are exposed through the plurality of second elongated hole sections 25 and the plurality of round hole sections 26 to form four holes at the smallest first pitch pt1. Further, the plurality of third nut holes 63 of the nut plate 60 are exposed through the plurality of first elongated hole sections 24 to form four holes of the largest third pitch pt3. In addition, one of the plurality of second nut holes 62 is exposed through an opening end portion in a lower area of the third elongated hole section 27.

Meanwhile, in order to form four holes at the second pitch pt2, which is larger than the first pitch pt1 and smaller than the third pitch pt3, from a state illustrated in FIG. 4, for example, the nut plate 60 is rotated by 45° by appropriately operating the operation jig 69 as described above, and a state after rotation which is illustrated in FIG. 5 is thereby established. Accordingly, as illustrated in FIG. 5, the plurality of second nut holes 62 are respectively exposed through the opening end portions of the plurality of first elongated hole sections 24, which are closer to the central opening 23, for example.

In this state, the plurality of second nut holes 62 are exposed through the plurality of first elongated hole sections 24 to form four holes at the second pitch pt2 as a so-called intermediate pitch. Note that in this case, one set of the plurality of first nut holes 61 becomes a state where those are respectively exposed through the opening end portions in upper areas of the plurality of second elongated hole sections 25, but this is not an exposing form where four holes are formed. Further, one of the plurality of first nut holes 61 is exposed through the opening end portion in the upper area of the third elongated hole section 27, and part of one of the plurality of third nut holes 63 is exposed through the opening end portion in the lower area of the third elongated hole section 27.

When a state, which is illustrated in FIG. 5, after rotation and where the operation jig 69 is not attached is again returned to the state illustrated in FIG. 4, for example, the operation jig 69 is attached to the first nut hole 61 which is exposed through the opening end portion in the upper area of the second elongated hole section 25 on the left side as viewed from the front. Subsequently, by appropriately operating the operation jig 69, the nut plate 60 may be rotated by 45°, for example, in a direction indicated by an arrow CCW in FIG. 5. Note that the operation jig 69 is attached to the first nut hole 61 which appears in either one of the plurality of second elongated hole sections 25, and an operation may thereby be performed to appropriately rotate the nut plate 60 as described above.

Further, as illustrated in FIG. 1, when a fixing bolt 67 for temporary fixation is fastened to the second nut hole 62 which is exposed through the opening end portion in the lower area of the third elongated hole section 27, the nut plate 60 is temporarily fixed to the pump body 20 in a state, which is illustrated in FIG. 4, where the four holes at the first pitch pt1 and the four holes at the third pitch pt3 are formed. Similarly, when the fixing bolt 67 for temporary fixation is fastened to the first nut hole 61 which is exposed through the opening end portion in the upper area of the third elongated hole section 27, the nut plate 60 is temporarily fixed to the pump body 20 in a state, which is illustrated in FIG. 5, where the four holes at the second pitch pt2 are formed.

By temporarily fixing the nut plate 60 to the pump body 20 in such a manner, it is possible to prevent the nut plate 60 from being unintentionally rotated and causing positional relationships between the hole sections 24 to 26 of the front wall 22 and the nut holes 61 to 63 to be deviated, which significantly deteriorates workability, when transporting the pump body 20 or attaching and detaching the pump head 30 or the like.

Note that as illustrated in FIG. 1, when in a portion on a rear end side of the bracket 40, a clearance groove portion 43 is formed in which a head portion of the fixing bolt 67 for temporary fixation can be arranged in a non-contact manner, it is possible to attach and detach the pump head 30, the bracket 40, and the diaphragm 50 to and from the pump body 20 while a state is maintained where the fixing bolt is fastened and the mounting pitches of the nut plate 60 are fixed.

When the nut plate 60 is rotated in such a manner to each of the states illustrated in FIG. 4 and FIG. 5, as illustrated in FIG. 7, the bracket 40 is installed on the front wall 22 of the pump body 20. FIG. 8 to FIG. 10 illustrate appearances of the pump body 20 in a state illustrated in FIG. 7 as viewed from the front. When the bracket 40, which is manufactured such that the pitch of the plurality of through holes 41 conforms to the third pitch pt3, is installed on the front wall 22 of the pump body 20, its appearance becomes like an illustration in FIG. 8. That is, through the plurality of through holes 41, the plurality of sets of third nut holes 63 can be seen which respectively appear through the opening end portions being more distant from the central openings 23 of the first elongated hole sections 24 of the front wall 22.

Meanwhile, when a bracket 40A, which is manufactured such that the pitch of the plurality of through holes 41 conforms to the second pitch pt2, is installed on the front wall 22 of the pump body 20, its appearance becomes like an illustration in FIG. 9. That is, through the plurality of through holes 41, the plurality of sets of second nut holes 62 can be seen which respectively appear through the opening end portions being closer to the central openings 23 of the first elongated hole sections 24 of the front wall 22.

In addition, when a bracket 40B, which is manufactured such that the pitch of the plurality of through holes 41 conforms to the first pitch pt1, is installed on the front wall 22 of the pump body 20, its appearance becomes like an illustration in FIG. 10. That is, through the plurality of through holes 41, the plurality of sets of first nut holes 61 can be seen which respectively appear through the opening end portions in the lower areas of the second elongated hole sections 25 and the round hole sections 26 of the front wall 22.

In such a manner, in a state where the housing space 21 of the pump body 20 is tightly closed, the bracket 40 (40A or 40B) is attached to the front wall 22 of the pump body 20 to be exchangeable for each of the pitches of the plurality of through holes 41 which corresponds to any one set of the nut holes among the first nut holes 61, the second nut holes 62, and the third nut holes 63 of the nut plate 60. Note that the plurality of mounting holes 19 of the pump head 30 are formed such that their pitch matches the pitch of the plurality of through holes 41 of the bracket 40 (40A or 40B).

Consequently, as illustrated in FIG. 6, for example, the mounting bolts 68 are fastened, from the pump head 30 side, to one set of the nut holes among the pluralities of nut holes 61 to 63 of the nut plate 60, which conform to the pitch of the pluralities of mounting holes 19 and through holes 41, via at least one set of the hole sections among the pluralities of first elongated hole sections 24, second elongated hole sections 25, and round hole sections 26 of the front wall 22 of the pump body 20, and the pump head 30 and the bracket 40 can thereby easily be fixed to the front wall 22 of the pump body 20.

An example illustrated in FIG. 6 illustrates a case where the pump head 30 and the bracket 40 which are applicable to a case where a volume size of the pump chamber 31 is large, for example, are fixed to the pump body 20 by attaching the mounting bolts 68, which are inserted through the mounting holes 19 formed in the pump head 30 at the conforming pitch and through the through holes 41 formed in the bracket 40 at the conforming pitch, the conforming pitch conforming to the plurality of third nut holes 63 which form the mounting pitch of the largest third pitch pt3 of the nut plate 60.

In the pump device 100 of the present embodiment, as described above, the first to third nut holes 61 to 63 of the nut plate 60 form three different mounting pitches, for example. Thus, it becomes possible to easily attach and detach three kinds of the pump heads 30 having the pump chamber 31 with different volume sizes (different dimensions) and the bracket 40 suitable for the pump heads 30 to and from the front wall 22 of the pump body 20 without disassembling the pump body 20 side at all.

Note that similarly, the diaphragm 50 that is arranged in a central position of the bracket 40 which appropriately corresponds to the size of the pump chamber 31 and to the dimensions of the pump head 30 can easily be attached and detached and can be attached to be exchangeable in accordance with the volume size or the like of the pump chamber 31 of the pump head 30 in a state where the solenoid 10 side of the housing space 21 of the pump body 20 is liquid-tightly isolated from the front wall 22 and the nut plate 60 side by the waterproof plate 70 having the O-rings 75 and 76.

In such a manner, in the pump device 100 of the present embodiment, while a tightly closed state of the housing space 21 of the pump body 20 is maintained, it is possible to easily attach and detach the pump head 30 and the bracket 40 to and from the pump body 20 by operations such as fastening and loosening the mounting bolts 68 from the pump head 30 side. For example, in a case where the bracket 40 has to be replaced due to damage or the like, the mounting bolts 68 are first loosened and removed, and the pump head 30 and the diaphragm 50 are thereby detached from the bracket 40 (see FIG. 7). Next, the bracket 40 is detached from the front wall 22 of the pump body 20 (see FIG. 11) and is replaced with a replacement product. When the replacement product with a different size is attached, as described above, the nut plate 60 is rotated to conform to the pitch of the pluralities of mounting holes 19 and through holes 41, the bracket 40, the diaphragm 50, and the pump head 30 are installed on the front wall 22 of the pump body 20, and those may then be fixed together by fastening the mounting bolts 68.

Consequently, for example, in such cases where the bracket 40 is damaged due to formation of a crack, where the nut plate 60 is rotated accidentally, where a liquid enters an inside of the front wall 22 from the outside through the mounting bolt 68, and where attachment of the pump head 30 is loose (insecure), even when a problem occurs to the pump head 30 side and its waterproof property is impaired, entry of the liquid into the solenoid 10 side in the housing space 21 of the pump body 20 is certainly prevented by the waterproof plate 70 having the O-rings 75 and 76. In such a manner, in the pump device 100 of the present embodiment, the waterproof property in the housing space 21 of the pump body 20 is secured regardless of any problem with the pump head 30 side.

Note that the nut plate 60, which is arranged to be rotatable along the front wall 22 in the housing space 21 of the pump body 20, is housed in the housing space 21 while having a slight gap between the nut plate 60 and the back surface 22*a* of the front wall 22, for example. However, except a case where the nut plate 60 is fully fixed after temporary fixation by the fixing bolt for temporary fixation, the pump head 30, the bracket 40, and the diaphragm 50 are installed on the front surface 22*b* side of the front wall 22 of the pump body 20, the mounting bolts 68 are fastened and fixed to the appropriate nut holes of the nut plate 60 via the mounting holes 19 and the through holes 41, and the nut plate 60 tightly contacts with the back surface 22*a* of the front wall 22 of the pump body 20 in the housing space 21 to be unrotatable. Consequently, it becomes possible to certainly and firmly fix the pump head 30 and the bracket 40 to the front wall 22 of the pump body 20 while the waterproof property on the solenoid 10 side in the housing space 21 is secured.

As described above, the pump device 100 according to the present embodiment makes it possible to easily attach and detach the pump head 30, which has the different mounting pitch of the mounting bolts 68, and the bracket 40 to and from the pump body 20 without disassembling a whole pump. Furthermore, it is possible to eliminate a risk of entry of a liquid into the solenoid 10 side in the interior of the housing space 21 during disassembly of the pump head 30 side.

In the foregoing, the embodiment of the present invention is described, but this embodiment is presented as an example and is not intended to limit the scope of the invention. This novel embodiment can be carried out in various other forms, and various kinds of omissions, substitutions, and changes can be made without departing from the scope of the gist of the invention. Those embodiments and their modifications are included in the scope of the gist of the invention and are also included in the invention recited in the claims and its equivalents.

For example, in the above embodiment, a structure is made in which the pluralities of hole sections 24 to 26 are formed in the front wall 22 of the pump body 20, the pluralities of nut holes 61 to 63 are formed in the nut plate 60, and the nut holes at three different kinds of mounting pitches are thereby exposed through the hole sections 24 to 26 of the front wall 22 by rotation of the nut plate 60. Those hole sections 24 to 26 and nut holes 61 to 63 can employ various kinds of forms of opening shapes and hole arrangement (formation) in order to realize more mounting pitches other than the above mounting pitches.

Further, in the above embodiment, a configuration is made in which the pump device 100 includes the waterproof plate 70 and the fixing plate 80, but this is not restrictive. In a case where a configuration of the present invention is applied to a pump device which does not place importance on the waterproof property or a pump device of a type in which the solenoid 10 is fixed by the pump body 20 itself (such as a type in which two divided bodies are fastened together and fixed, for example), for example, because employment of those plates 70 and 80 is selectable, those plates 70 and 80 are not required components.

Further, in the above embodiment, a configuration is made in which the third fitting portion 73 of the waterproof plate 70 protrudes to the opposite side to the first fitting portion 71 and the second fitting portion 72, but this is not restrictive.

For example, when a recess portion is formed in an outer peripheral edge portion on a rear side of the nut plate 60, the third fitting portion 73 may be configured to protrude in the same direction as the first and second fitting portions 71 and 72.

REFERENCE SIGNS LIST

10 solenoid
19 mounting hole
20 pump body
22 front wall
24 first elongated hole section
25 second elongated hole section
26 round hole section
27 third elongated hole section
30 pump head
40 bracket
41 through hole
50 diaphragm
60 nut plate
61 first nut hole
62 second nut hole
63 third nut hole
70 waterproof plate
75, 76 O-ring
80 fixing plate
100 pump device

The invention claimed is:

1. A pump device comprising:

a drive source;

a pump body that has a first wall and a housing space housing the drive source inside on one side of the first wall;

a pump head that has a pump chamber, and a suction port and a discharge port for transfer fluid communicating with the pump chamber, and the pump head being attached to another side of the first wall;

a bracket that is arranged between the pump head and the first wall;

a drive member that is driven in the pump chamber by the drive source; and a nut plate that has an annular shape and is arranged adjacent to the first wall in the housing space of the pump body, wherein the nut plate has a plurality of sets of nut holes at different distances from a center and is arranged to be rotatable along the first wall around an axis which passes through the center and intersects with the first wall, the first wall has a plurality of hole sections which are arranged at positions corresponding to the plurality of sets of nut holes, part of the plurality of hole sections are elongated hole sections which extend in a circumferential direction of the nut plate, and the pump head and the bracket have a plurality of through holes that are arranged at a pitch which conforms to any one set of the plurality of sets of nut holes of the nut plate, and the pump head and the bracket are fixed to the first wall of the pump body by fastening bolts, via the hole sections of the first wall, to the one set of the nut holes of the nut plate conforming to the pitch of the plurality of through holes.

2. The pump device according to claim 1, further comprising a waterproof plate that is arranged between the nut plate and the drive source in the housing space and liquid-tightly isolates the drive source from an outside of the pump body.

3. The pump device according to claim 2, further comprising a fixing plate that fixes the drive source from an opposite side to the first wall of the pump body and is attached to the pump body to block the housing space.

4. The pump device according to claim 2, wherein the drive source has a drive shaft to a tip of which the drive member is attached, and in the nut plate, at least one set of the nut holes of the plurality of sets of nut holes is arranged in different positions in a circumferential direction of the nut plate with respect to other sets of the nut holes.

5. The pump device according to claim 4, wherein the first wall has a central opening through which the drive shaft of the drive source is inserted, a plurality of first elongated hole sections of the plurality of hole sections which are formed around the central opening to radially open and in which part of the nut holes of the plurality of sets of nut holes appear at a position of the nut plate in a rotation direction, a plurality of second elongated hole sections of the plurality of hole sections which are formed around the central opening to open along a circumferential direction of the central opening while being spaced apart from the plurality of first elongated hole sections and in which other part of the nut holes of the plurality of sets of nut holes appear at a position of the nut plate in the rotation direction, and a plurality of round hole sections of the plurality of hole sections which are arranged around the central opening to be spaced apart from the plurality of first elongated hole sections and the plurality of second elongated hole sections, and in which other remaining nut holes of the plurality of sets of nut holes appear at a position of the nut plate in the rotation direction.

6. The pump device according to claim 5, wherein the first wall further has a third elongated hole section of the plurality of hole sections which is formed around the central opening to radially open while being spaced apart from the plurality of first elongated hole sections, the plurality of second elongated hole sections and the plurality of round hole sections, and in which one nut hole of a set of the plurality of sets of nut holes appears at a position of the nut plate in the rotation direction.

7. The pump device according to claim 4, wherein the plurality of sets of nut holes, which are provided in the nut plate, have first nut holes, second nut holes each of which is provided at a position at a longer distance from the center than the first nut holes, and third nut holes each of which is provided at a position at a longer distance from the center than the second nut holes, the first nut holes and the third nut holes are arranged at the same positions in a circumferential direction and are respectively and evenly arranged at four positions in the circumferential direction, and the second nut holes are evenly arranged at four positions in the circumferential direction and are arranged at positions which are deviated by 45° in the circumferential direction with respect to the first nut hole and the third nut hole.

8. The pump device according to claim 5, wherein the waterproof plate is formed of a resin member that has a disk portion which is opposed to the nut plate, a first fitting portion which protrudes along the drive shaft from an inner peripheral edge portion of the disk portion and is fitted in an inner peripheral portion of the nut plate, a second fitting portion which protrudes from the first fitting portion along the drive shaft and is fitted in the central opening of the first wall, and a third fitting portion which is fitted in an inner peripheral wall of the housing space.

9. The pump device according to claim 8, wherein the waterproof plate has a first sealing portion which is arranged in an outer peripheral portion of the second fitting portion and seals a portion between the waterproof plate and an inner peripheral portion of the central opening of the first wall and a second sealing portion which is arranged in an outer peripheral portion of the disk portion and seals a portion between the waterproof plate and the inner peripheral wall of the housing space.

10. The pump device according to claim 3, wherein the drive source and the waterproof plate are fixed to an inside of the housing space of the pump body by fastening bolts to mounting nuts, which are provided on an outside of the housing space of the pump body, via a plurality of through holes provided in the fixing plate.

11. The pump device according to claim 10, wherein the pump body is formed of a resin member, and the mounting nuts are integrally embedded in the pump body.

12. The pump device according to claim 7, wherein in a state where the housing space of the pump body is tightly closed, the bracket is attached to the first wall of the pump body to be exchangeable for each pitch of the plurality of through holes which corresponds to any one set of the nut holes among the first nut holes, the second nut holes and the third nut holes of the nut plate.

13. The pump device according to claim 1, wherein the nut plate tightly contacts with the one side of the first wall of the pump body to be unrotatable when the pump head and the bracket are fixed to the other side of the first wall of the pump body.

14. The pump device according to claim 5, wherein the plurality of sets of nut holes, which are provided in the nut plate, have first nut holes, second nut holes each of which is provided at a position at a longer distance from the center than the first nut holes, and third nut holes each of which is provided at a position at a longer distance from the center than the second nut holes, the first nut holes and the third nut holes are arranged at the same positions in a circumferential direction and are respectively and evenly arranged at four positions in the circumferential direction, and the second nut holes are evenly arranged at four positions in the circumferential direction and are arranged at positions which are deviated by 45° in the circumferential direction with respect to the first nut hole and the third nut hole.

15. The pump device according to claim 6, wherein the plurality of sets of nut holes, which are provided in the nut plate, have first nut holes, second nut holes each of which is provided at a position at a longer distance from the center than the first nut holes, and third nut holes each of which is provided at a position at a longer distance from the center than the second nut holes, the first nut holes and the third nut holes are arranged at the same positions in a circumferential direction and are respectively and evenly arranged at four positions in the circumferential direction, and the second nut holes are evenly arranged at four positions in the circumferential direction and are arranged at positions which are deviated by 45° in the circumferential direction with respect to the first nut hole and the third nut hole.

16. The pump device according to claim 6, wherein the waterproof plate is formed of a resin member that has a disk portion which is opposed to the nut plate, a first fitting portion which protrudes along the drive shaft from an inner peripheral edge portion of the disk portion and is fitted in an inner peripheral portion of the nut plate, a second fitting portion which protrudes from the first fitting portion along the drive shaft and is fitted in the central opening of the first wall, and a third fitting portion which is fitted in an inner peripheral wall of the housing space.

* * * * *